US006468029B2

(12) United States Patent
Teplanszky

(10) Patent No.: US 6,468,029 B2
(45) Date of Patent: Oct. 22, 2002

(54) PUMP DEVICE

(76) Inventor: George J. Teplanszky, 15 Sunrise Pl., Durham, NC (US) 27705

( * ) Notice: Subject to any disclaimer, the term of this patent is extended or adjusted under 35 U.S.C. 154(b) by 0 days.

(21) Appl. No.: 09/789,874

(22) Filed: Feb. 21, 2001

(65) Prior Publication Data

US 2002/0114694 A1 Aug. 22, 2002

(51) Int. Cl.[7] ..... F04D 1/04
(52) U.S. Cl. ..... 415/72; 415/116; 416/177
(58) Field of Search ..... 415/71, 72, 116, 415/219.1; 416/176, 177

(56) References Cited

U.S. PATENT DOCUMENTS

| | | | | | |
|---|---|---|---|---|---|
| 399,101 | A | * | 3/1889 | West | 415/186 |
| 649,546 | A | * | 5/1900 | Porter | 384/40 |
| 2,887,959 | A | | 5/1959 | Stefano | |
| 3,431,855 | A | | 3/1969 | Kazantsev et al. | |
| 3,632,219 | A | | 1/1972 | Tayler | |
| 3,951,565 | A | * | 4/1976 | Rothe et al. | 415/1 |
| 4,150,542 | A | * | 4/1979 | Spears | 417/177 |
| 4,275,988 | A | | 6/1981 | Kalashnikov et al. | |
| 4,357,797 | A | * | 11/1982 | Siptrott | 415/72 |
| 4,415,308 | A | * | 11/1983 | Maruyama et al. | 415/168.3 |
| 5,375,975 | A | | 12/1994 | Yu et al. | |
| 5,487,650 | A | | 1/1996 | Gaston et al. | |
| 5,549,451 | A | * | 8/1996 | Lyda, Jr. | 415/218.1 |
| 5,846,055 | A | * | 12/1998 | Brodersen et al. | 415/206 |
| 6,066,193 | A | | 5/2000 | Lee | |
| 6,068,454 | A | | 5/2000 | Gaston et al. | |

* cited by examiner

*Primary Examiner*—Edward K. Look
*Assistant Examiner*—Igor Kershteyn
(74) *Attorney, Agent, or Firm*—Miller Patent Services; Jerry A. Miller

(57) ABSTRACT

A pump device for pumping a fluid having a housing which includes an inner wall to form a cavity. The device further includes an impeller rotatably mounted in the housing and residing in the cavity, wherein the impeller includes a cylindrical portion and first and second helixes that extend above the cylindrical portion. The first helix is adjacent the second helix such that the first and second helixes are interleaved with each other along a length of the impeller. The device also includes at least one inlet port formed in the housing for receiving fluid into the cavity, wherein upon rotation of the impeller, the fluid is caused to move in an axial direction and in a radial direction such that a centrifugal force is generated causing the fluid to move to the inner wall. A reaction force is then generated that causes the fluid to move back toward the impeller to increase friction between the impeller and the fluid to thereby increase the amount of fluid that is moved by the impeller. In addition, the device includes an outlet port for discharging fluid from the cavity.

22 Claims, 2 Drawing Sheets

PUMP DEVICE

FIELD OF THE INVENTION

This invention relates to pumps, and more particularly, to a pump which includes an impeller having two helixes and which rotates to cause centrifugal force to move a fluid.

BACKGROUND OF THE INVENTION

Pumps have long been used to raise or transport fluids for a variety of purposes. This has led to the manufacture of several types of pumps and the establishment of various pump classifications. A widely used classification is based on the method by which energy is imparted to the fluid being pumped. One method includes the use of a positive displacement pump to mechanically displace the fluid. In such pumps, a reciprocating device such as a piston is used to displace fluid out of a chamber. Alternatively, the fluid may be displaced by a rotary device having gears, vanes or a helical screw.

Another method includes the use of a kinetic device to impart energy to the fluid. Kinetic devices include, for example, centrifugal pumps and axial flow pumps. A centrifugal pump includes a rotating impeller having vanes for receiving fluid. As the impeller rotates, a centrifugal force is generated that is imparted to the fluid. The fluid then gains energy as it moves to the outer diameter of the impeller. Ultimately, this causes the fluid to be forced out of the pump in a direction substantially perpendicular to the axis of rotation of the impeller.

An axial flow pump includes a rotating shaft having vanes. As the shaft rotates, a fan like action is generated by the vanes that serves to accelerate the fluid in an axial direction and through the pump housing. Various techniques have been implemented to improve the efficiency and axial flow rate for the device. These include varying the spacing of the vanes or varying the angle of the vanes relative to the shaft axis.

SUMMARY OF THE INVENTION

The present invention relates generally to an improved pump device.

Objects, advantages and features of the invention will become apparent to those skilled in the art upon consideration of the following detailed description of the invention.

The present invention can be embodied in many forms. Certain embodiments of the present invention are directed to a pump device for pumping a fluid. The device includes a housing having a cavity and at least one inlet port formed in the housing for receiving fluid into the cavity. The housing further includes an outlet port for discharging the fluid from the cavity. In addition, the device includes an impeller that is rotatably mounted in the housing and resides in the cavity, wherein the impeller includes a cylindrical portion and first and second helixes that extend above the cylindrical portion. The first helix is adjacent the second helix such that the first and second helixes are interleaved with each other along a length of the impeller, wherein upon rotation of the impeller fluid is discharged from the outlet port.

In another embodiment consistent with the invention, a pump device for pumping a fluid has a housing having a cavity. At least one inlet port is formed in the housing for receiving the fluid into the cavity. An outlet port is formed in the housing for discharging the fluid from the cavity. An impeller is rotatably mounted in the housing and resides in the cavity. The impeller has a main portion and a plurality of helixes that extend above the main portion, wherein the plurality of helixes are adjacent and interleaved with each other along a length of the impeller, wherein upon rotation of the impeller the fluid is discharged from the outlet port.

In another exemplary embodiment consistent with the present invention, a pump device for pumping a fluid has a housing having an inner wall to form a cavity. An impeller is mounted in the housing and resides in the cavity, the impeller having a main portion and first and second helixes that extend above the main portion, wherein the first helix is adjacent the second helix such that the first and second helixes are interleaved with each other along a length of the impeller. At least one inlet port is formed in the housing for receiving the fluid into the cavity, wherein upon rotation of the impeller, the fluid is caused to move in an axial direction and in a radial direction such that a centrifugal force is generated to cause the fluid to move to the inner wall, wherein a reaction force is generated that causes the fluid to move back toward the impeller to increase friction between the impeller and the fluid to thereby increase the amount of fluid that is moved by the impeller. An outlet port is formed in the housing for discharging the fluid from the cavity.

In yet another embodiment consistent with the invention, a pump device for pumping a fluid has a housing having an inner wall to form a cavity. An impeller is rotatably mounted in the housing by bearings to reside in the cavity. The impeller has a main portion and first and second helixes that extend above the main portion, wherein the first helix is adjacent the second helix such that the first and second helixes are interleaved with each other along a length of the impeller and wherein a groove is formed between the first and second helixes. At least one inlet port is formed in the housing for receiving the fluid into the cavity, wherein upon rotation of the impeller, the fluid is caused to move in an axial direction due to friction between the fluid and the impeller and in a radial direction such that a centrifugal force is generated to cause the fluid to move to the inner wall, wherein a reaction force is generated that causes the fluid to move back toward the impeller and within the groove to increase friction between the impeller and the fluid to thereby increase the amount of fluid that is moved by the impeller. An outlet port is formed in the housing for discharging the fluid from the cavity.

In another embodiment consistent with the present invention, a pump device for pumping a fluid includes a housing having an inner wall to form a cavity. An impeller is rotatably mounted in the housing by bearings and resides in the cavity. The impeller has a main portion and first and second helixes that extend above the main portion, wherein the first helix is adjacent the second helix such that the first and second helixes are interleaved with each other along a length of the impeller and wherein a groove is formed between the first and second helixes. At least one inlet port is formed in the housing for receiving the fluid into the cavity, wherein upon rotation of the impeller, the fluid is caused to move in an axial direction due to friction between the fluid and the impeller and in a radial direction such that a centrifugal force is generated which is a result of a squaring of an angular velocity of the impeller which ultimately results in a generation of kinetic energy and wherein the energy exponentially increases with every linear increase in rotational speed to cause the fluid to move to the inner wall, wherein a reaction force is generated that causes the fluid to move back toward the impeller and within the groove to increase friction between the impeller and the fluid to thereby increase the amount of fluid that is moved by the impeller. An outlet port is formed in the housing for discharging the fluid from the cavity.

The above summaries are intended to illustrate exemplary embodiments of the invention, which will be best understood in conjunction with the detailed description to follow, and are not intended to limit the scope of the appended claims.

The features of the invention believed to be novel are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
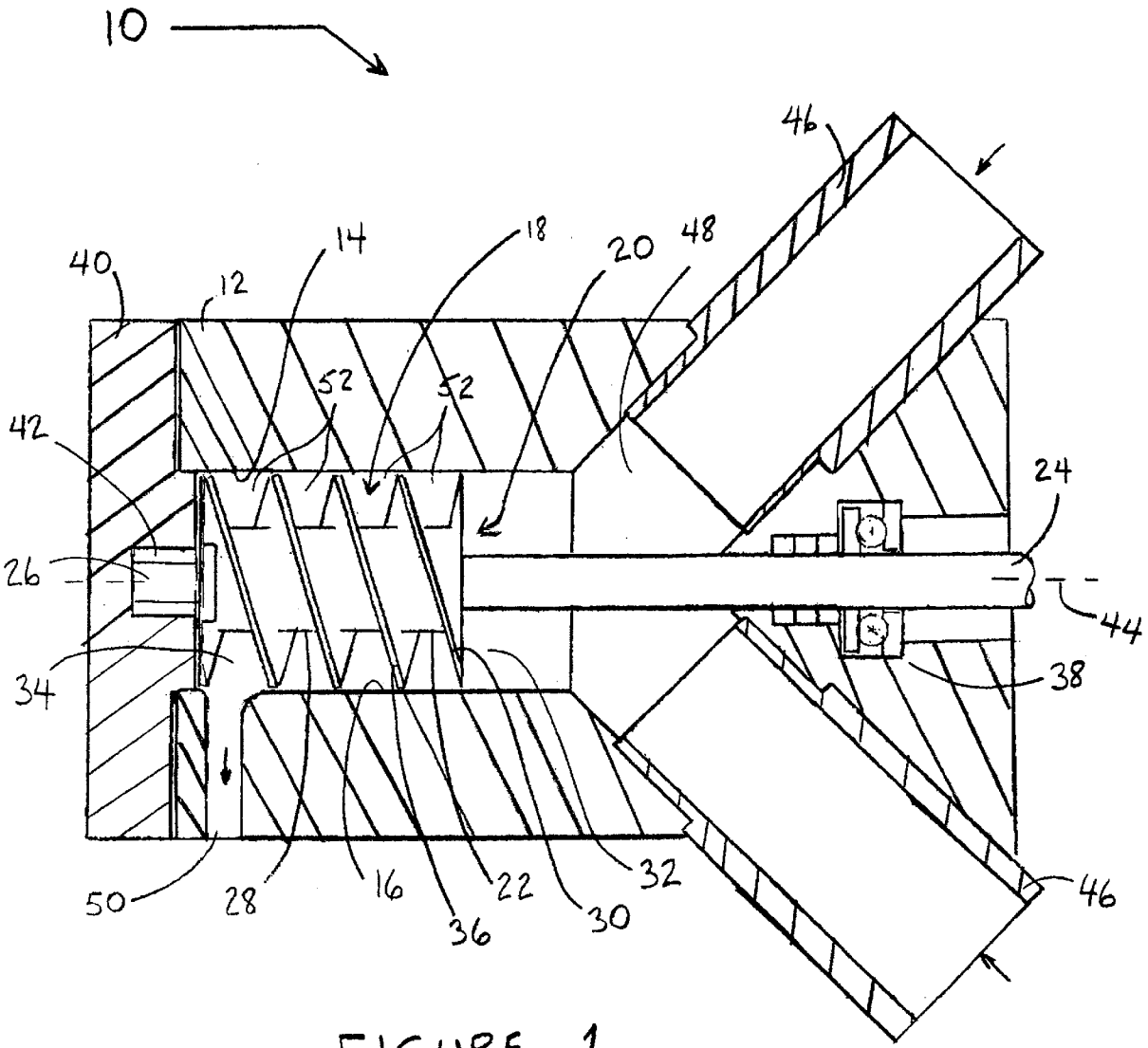
FIG. 1 is a cross sectional view of an improved pumping device in accordance with an embodiment of the present invention.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described. In the description below, like reference numerals are used to describe the same, similar or corresponding parts in FIGS. 1–3.

Referring to FIG. 1, a cross sectional view of an improved pump device 10 in accordance with the present invention is shown. It is noted that the present invention may be used to pump any type of fluid, although it is preferable that the fluid have a relatively low viscosity. In particular, the preferred fluids which may be pumped include water, seawater, hydraulic fluids, chemicals that have minimal corrosive capability and fluids whose characteristics remain relatively unchanged as a result of minor temperature variations. However, other fluids may also be pumped without limitation.

The device 10 includes a housing 12 having first 14 and second 16 side walls separated by a cylindrically shaped pump cavity 18. The device 10 further includes an impeller 20 having a cylindrical portion 22 located between first 24 and second 26 shafts. An outside surface 28 of the cylindrical portion 22 includes a first helix 30 that extends above the outside surface 28. The first helix 30 is shaped as an advancing spiral that extends from an inlet end 32 to an outlet end 34 of the cylindrical portion 22 to form a first continuous vane. The cylindrical portion 22 further includes a second helix 36 that is spaced apart from, and adjacent to, the first helix 30. The second helix 36 is also shaped as an advancing spiral that extends from the inlet end 32 to the outlet end 34. This forms a second continuous vane that is interleaved with the first vane along the length of the impeller 20. This results in an impeller 20 having two helixes, wherein a groove 52 is formed between the first 30 and second 36 helixes. In one embodiment, the first 30 and second 36 helixes are parallel to each other. Also, it is noted that additional helixes may be utilized, although it is preferred that the impeller 20 have an even number of helixes so that the impeller 20 is suitably balanced when rotating at relatively high speeds.

The housing 12 includes a first bearing assembly 38 and an end cap 40 having a second bearing assembly 42. The first 24 and second 26 shafts are supported by the first 38 and second 42 bearings, respectively, to enable rotation of the impeller 20 about a longitudinal axis 44. Alternatively, it is understood that other devices may be used to enable rotation of the impeller 20. Further, it is noted that a thrust bearing may be utilized so as to absorb the pressure of the fluid as it contacts the impeller 20.

The housing 12 also includes inlet ports 46 for receiving fluid (designated by arrows) into an inlet cavity 48 that is in fluid communication with the pump cavity 18. In use, fluid which enters the inlet ports 46 is moved toward the inlet end 32. The inlet ports 46 are sized and oriented relative to the axis 44 so as to minimize the undesirable generation of a vacuum as fluid is drawn into the device 10 which would result in a loss in efficiency and the entry of air into the device 10. Devices such as oil seals or Teflon™ V rings may be utilized to reduce or substantially eliminate air leaks. In addition, the sensitivity of the V rings may be improved by surrounding the rings with a soft elastomeric bushing, such as those available from McMaster-Carr, P.O. Box 740100, Atlanta, Ga, Catalog Number 99.

In one embodiment of the device 10, the inlet ports 46 may have an inner diameter of approximately 0.875 inches. Further, the inlet ports 46 may be spaced symmetrically about the axis 44. The actual configuration of the inlet ports 46 depends on several factors including the rotational speed of the impeller 20 and others. Alternatively, it is noted that a single inlet port may be utilized or that additional inlet ports may be added. In one embodiment, the inlet port or ports 46 are disposed at an angle of approximately 45° relative to the axis 44, but this is not to be considered limiting.

In addition, the housing 12 includes an outlet port 50 that extends between the pump cavity 18 and outside the device 10. The outlet port 50 is positioned adjacent the outlet end 34 and provides a path through which fluid is expelled from the pump cavity 18 (preferably, at a 90° angle relative to the axis 44). In one embodiment of the device 10, the outlet port 50 may have an inner diameter of approximately 0.234 inches.

In operation, the first shaft 24 and thus the impeller 20 are caused to rotate at a desired rotational speed. By way of example, the first shaft 24 may be coupled to a turbine, diesel engine, electric motor or other device which rotates the first shaft 24. Rotation of the impeller 20 causes fluid to move in an axial direction due to friction between the first 30 and second 36 helixes and the fluid. Further, the rotational speed also causes the generation of a centrifugal force that also moves fluid in a radial direction toward the side walls 14,16. This generates an equal and opposite reaction force which moves the fluid back toward the first 30 and second 36 helixes and within the groove 52, thus increasing friction between the impeller 20 and the fluid. In accordance with the present invention, the increased friction results in additional fluid being pumped by the impeller 20. As such, fluid is pumped through the device 10 as a result of both the axial velocity and as a result of the kinetic energy arising from the centrifugal force. This is believed to substantially increase pump efficiency and result in additional fluid being pumped than that which is capable with prior pump configurations. In addition, the increased friction enables the surfaces of the first 30 and second 36 helixes to be relatively smooth and reduces the need for paddle like protrusions for moving the fluid. Further, it is noted that the degree of surface smoothness of the first 30 and second 36 helixes may be chosen so as to compensate for the viscosity of the fluid being pumped in order to provide suitable friction characteristics. If a rough texture is desired, it can be produced by sand blasting, etching, scoring or any other suitable texturing technique.

Figure 2:
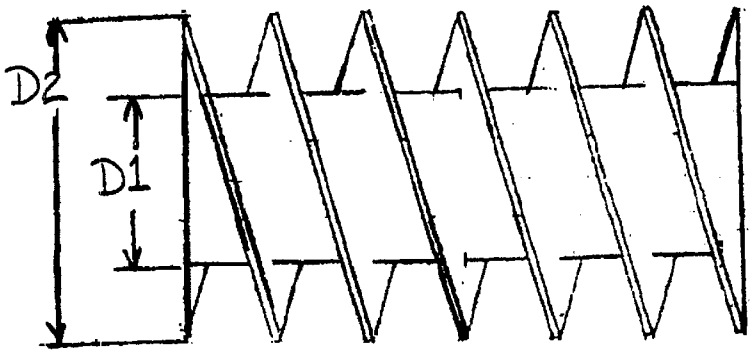
FIG. 2 is a view on an impeller consistent with an embodiment of the improved pumping device.
Figure 3:
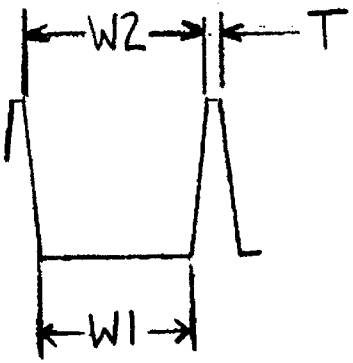
FIG. 3 is a view of a groove of the impeller of FIG. 2.

Referring to FIGS. 2 and 3, enlarged views of the impeller 20 and the groove 52, respectively, are shown. Formulas describing the theoretical operation of the present invention will now be described in conjunction with FIGS. 2 and 3. However, it is not intended that the scope of the appended claims be limited by the following theoretical explanation except to the extent set forth in the claims.

The effective pitch of the dual helix arrangement (DP) is given by:

$$P=W2+T$$

DP=double pitch=2×P, where W2 is the upper width of the groove and T=edge thickness of a helix.

The average diameter ($D_{avg}$) is given by:

$$D_{avg}=(D2+D1)/2,$$

where D2=outer diameter of the impeller and D1=diameter of cylindrical portion 22.

The length (L) of the double helix is given by $$L=([D_{avg}\times\pi]^2+Dp^2)^{1/2}$$

The cross sectional area (A) of the impeller 20 is given by:

$$A=[(W2+W1)/2]\times[(D2-D1)/2],$$

where W1 is the lower width of the groove.

The approximate volume of fluid moved over time (V) is given by the following formula:

$$\text{V (in cubic centimeters per minute)}=L\times A\times\text{RPM}\times(2.54)^3,$$

where RPM represents the revolutions per minute of the impeller.

The velocity of a peripheral portion (PV) of the impeller 20 is given by:

$$PV(\text{meters/second})=2\times R\times\pi\times\text{RPM}/(60\times100),$$

where R=average radius=[(D2+D1)/4]×2.54. The peripheral velocity equation provides the velocity of a point located at the average radius of the impeller 20. It is noted that $D_{avg}$, L, A, V and PV are approximations since these are affected by the degree of slope of a helix or by any potential curvature of the walls of the groove 52.

The centrifugal velocity (CV) is given by:

$$CV(\text{meters/second})=R\times(2\times\pi\times\text{RPM}/60)^2\times60/(\text{RPM}\times100)$$

where:

R=average radius=[(D2 +D1)/4]×2.54;

$(2\times\pi\times\text{RPM}/60)^2$=square of the angular velocity.

The resultant velocity (RV) is given by:

$$RV(\text{meters/second})=(PV^2+CV^2)^{1/2}$$

The estimated obtainable elevation is given by:

$$\text{Elevation (meters)}=\text{equipment efficiency}\times RV^2/(2\times g),$$

where g=acceleration due to gravity.

The theoretical output is given by:

$$\text{Theoretical Output (horsepower)}=(V\times\text{Elevation})/(60\times75\text{ meters-kilogram/second})$$

where 1 liter of water=1 kilogram.

In one embodiment, the dimensions for the impeller 20 are as follows (all dimensions are in inches and are approximate, unless otherwise noted): W2=0.590, W1=0.490, T=0.050, D2=2.080, D1=1.100, RPM=3450 and g=9.81 meters/second$^2$. Further, the impeller 20 may include 3 complete spiral turns and have a 1.8461 length to diameter ratio. It is understood that other dimensions and parameters may be used. Further, it is noted operation of the pump causes heating of the fluid. In particular, each horsepower generated by the pump will introduce approximately 0.18 kilocalories per second volume.

The present invention captures the kinetic energy that is ultimately obtained when the angular velocity is squared. As a result, the present invention provides an exponentially increasing amount of output energy with every linear increase in rotational speed. By way of example, a rotational speed of 3000 revolutions per minute corresponds to a squared angular velocity of approximately 98,696 radians$^2$ per second$^2$. Further, a rotational speed of 6000 revolutions per minute corresponds to a squared angular velocity of approximately 394,784 radians$^2$ per second$^2$. As such, it can be seen that a doubling of the rotational speed yields substantially more than a doubling of the squared angular velocity.

In an alternate embodiment, additional or fewer spiral turns may be utilized.

In addition, the groove 52 may have a substantially conical shape. Further, the first 30 and second 36 helixes (or a greater number of helixes) may be formed on a tapered shaft to form a conically shaped impeller having a narrow end and a wide end. In this configuration, the impeller is oriented such that the narrow end receives fluid from the inlet ports 46 and the wide end is adjacent the outlet port 50. This type of impeller provides higher torque and enhanced coupling suitable for pumping a fluid of relatively high viscosity.

While the present embodiment uses a cylindrical pump cavity 18 with a mating impeller 20 having a cylindrical outer profile, this should not be considered limiting. In other embodiments, additional shapes can be used. In one such embodiment, a conical profile can be used for pump cavity 18 with a conical mating impeller 20. The conical mating impeller in such an embodiment includes two or more (preferably an even number) of helixes with the inlet port or ports 46 closest to the narrow end of the conical shape and the outlet port 50 adjacent the wider end of the conical shape. Other shapes will occur to those skilled in the art.

The present invention provides a pump having a substantially improved efficiency, thus reducing operating costs and energy consumption. The improved efficiency enables the construction of substantially smaller pumps thereby reducing space requirements in applications where pump size is important. Further, the pump has a relatively simple construction which further reduces costs and increases reliability. In addition, the pump may be readily adapted to accommodate fluid flows that require large volumes at smaller velocities so as to control noise.

The pump is suitable for use in many applications. One application is in the propulsion of marine vessels, where seawater is taken from the ocean which is then ultimately expelled by the pump back into the ocean to serve as a driving force for the vessel. Further, the pump may be used to steer a vessel by rotatably mounting the pump thereon or by using the pump in conjunction with a rudder. Other applications include motor vehicles, fire engines, hot tubs, water supply systems for high rise buildings and others. In addition, the fluid discharged from the pump may be used to drive other devices or pumps such as gear pumps, vane pumps and others that are configured to convert linear flow to rotary motion.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations are far within the scope of the appended claims.

What is claimed is:

1. A pump device for pumping a fluid, comprising:

a housing having a single cylindrically shaped cavity, said cavity having a length and having an inner wall;

a plurality of inlet ports formed in said housing for receiving said fluid into said cavity;

a single outlet port formed in said housing for discharging said fluid from said cavity;

each of said inlet ports having an opening size that is larger than an opening size of the outlet port;

a shaft which extends along the length of said cavity and which is rotatably mounted to said housing;

an impeller mounted to said shaft in said housing and residing in said cavity, said impeller having a main portion and a plurality of helixes that extend above said main portion, wherein said plurality of helixes are adjacent and interleaved with each other and continuous along a length of said impeller, and wherein the helixes of said impeller are uniform in pitch, depth and spacing between helixes, wherein upon rotation of said impeller said fluid is received from the inlet ports at an inlet end of said impeller and discharged from said outlet port at an outlet end of said impeller;

said shaft attached to the main portion of the impeller, and extending beyond the main portion of the impeller at the inlet end thereof;

wherein, the plurality of inlet ports are disposed symmetrically about the shaft adjacent said inlet end preceding an end of said impeller at an angle of approximately 45 degrees relative to the shaft;

wherein, the outlet port is disposed adjacent an outlet end of said impeller and expels the fluid at an angle of approximately 90 degrees relative to said shaft.

2. The device according to claim 1, wherein said device includes two inlet ports.

3. The device according to claim 1, wherein said shaft is rotatably mounted in said housing by ball bearings.

4. The device according to claim 1, wherein the helixes each have a surface and wherein the surfaces of said helixes are textured.

5. A pump device for pumping a fluid, comprising:

a housing having an inner wall that forms a cylindrical cavity;

a shaft which extends along an entire length of said cavity and rotatably mounted to said housing;

an impeller mounted to said shaft in said housing and residing in said cavity, said impeller having a main portion and first and second helixes that extend above said main portion, wherein said first helix is adjacent said second helix such that said first and second helixes are interleaved with each other along a length of said impeller;

the helixes of said impeller being uniform in pitch, depth and spacing between the helixes;

a plurality of inlet ports formed in said housing for receiving said fluid into said cavity, wherein upon rotation of said impeller, said fluid is caused to move in an axial direction and in a radial direction such that a centrifugal force is generated to cause said fluid to move to said inner wall, wherein a reaction force is generated that causes said fluid to move back toward said impeller to increase friction between said impeller and said fluid to thereby increase the amount of fluid that is moved by said impeller;

a single outlet port formed in said housing for discharging said fluid from said cavity wherein the outlet port is disposed adjacent an outlet end of said impeller and expels the fluid at an angle of approximately 90 degrees relative to said shaft;

each of said inlet ports having an opening size that is larger than an opening size of the outlet port;

said shaft attached to the main portion of the impeller, and extending beyond the main portion of the impeller at the inlet end thereof; and wherein, the plurality of inlet ports are disposed symmetrically about the shaft adjacent said inlet end preceding an end of said impeller at an angle of approximately 45 degrees relative to the shaft.

6. The device according to claim 5, wherein said device includes two inlet ports.

7. The device according to claim 5, wherein said shaft is rotatably mounted in said housing by ball bearings.

8. The device according to claim 5, wherein said device forms a part of a propulsion system for a marine vessel.

9. The device according to claim 5, wherein said first and second helixes are parallel to each other on a selected portion of said impeller.

10. The device according to claim 5, wherein said first and second helixes have textured surfaces.

11. A pump device for pumping a fluid, comprising:

a housing having an inner wall to form a cylindrical cavity;

a shaft which extends along an entire length of said cavity and which is rotatably mounted to said housing by ball bearings;

an impeller mounted to said shaft in said housing by bearings and residing in said cavity, said impeller having a main portion and first and second helixes that extend above said main portion, wherein said first helix is adjacent said second helix such that said first and second helixes are interleaved with each other along a length of said impeller and wherein a groove is formed between the first and second helixes, the first and second helixes of said impeller being uniform in pitch, depth and spacing between the helixes;

at least one inlet port formed in said housing for receiving said fluid into said cavity, wherein upon rotation of said impeller, said fluid is caused to move in an axial direction due to friction between said fluid and said impeller and in a radial direction such that a centrifugal force is generated to cause said fluid to move to said inner wall, wherein a reaction force is generated that causes said fluid to move back toward said impeller and within said groove to increase friction between said impeller and said fluid to thereby increase the amount of fluid that is moved by said impeller;

a single outlet port formed in said housing for discharging said fluid from said cavity;

an outlet port formed in said housing for discharging said fluid from said cavity wherein, the outlet port is disposed adjacent an outlet end of said impeller and expels the fluid at an angle of approximately 90 degrees relative to said shaft;

each of said inlet ports having an opening size that is larger than an opening size of the outlet port;

said shaft attached to the main portion of the impeller, and extending beyond the main portion of the impeller at the inlet end thereof; and wherein, the plurality of inlet ports are disposed symmetrically about the shaft adjacent said inlet end preceding an end of said impeller at an angle of approximately 45 degrees relative to the shaft.

12. The device according to claim 11, wherein said device includes two inlet ports each having an inner diameter of 0.875 inches, said outlet port has an inner diameter of 0.234 inches, said groove has an upper width of 0.590 inches and a lower width of 0.490 inches, and an overall diameter of said impeller is 2.080 inches and a diameter of a cylindrical portion on which said first and second helixes are formed is 1.100 inches.

13. The device according to claim 11, wherein said first and second helixes are parallel to each other on a selected portion of said impeller.

14. The device according to claim 11, wherein said main portion is cylindrically shaped to form a cylindrically shaped impeller.

15. The device according to claim 11, wherein said impeller rotates at 3450 revolutions per minute.

16. The device according to claim 11, wherein said first and second helixes have textured surfaces.

17. A pump device for pumping a fluid, comprising:

a housing having a cylindrical inner wall to form a cavity;

a shaft which extends along an entire length of said cavity and which is rotatably mounted to said housing by bearings;

an impeller mounted to said shaft in said housing and residing in said cavity, said impeller having a main portion and first and second helixes that extend above said main portion, wherein said first helix is adjacent said second helix such that said first and second helixes are interleaved with each other along a length of said impeller and wherein a groove is formed between the first and second helixes, the first and second helixes of said impeller being uniform in pitch, depth and spacing between the helixes;

at least one inlet port formed in said housing for receiving said fluid into said cavity, wherein upon rotation of said impeller, said fluid is caused to move in an axial direction due to friction between said fluid and said impeller and in a radial direction such that a centrifugal force is generated which is a result of a squaring of an angular velocity of said impeller which ultimately results in a generation of kinetic energy and wherein said energy exponentially increases with every linear increase in rotational speed to cause said fluid to move to said inner wall, wherein a reaction force is generated that causes said fluid to move back toward said impeller and within said groove to increase friction between said impeller and said fluid to thereby increase the amount of fluid that is moved by said impeller;

a single outlet port formed in said housing for discharging said fluid from said cavity;

wherein, the outlet port is disposed adjacent an outlet end of said impeller and expels the fluid at an angle of approximately 90 degrees relative to said shaft;

each of said inlet ports having an opening size that is larger than an opening size of the outlet port;

said shaft attached to the main portion of the impeller, and extending beyond the main portion of the impeller at the inlet end thereof; and wherein, the plurality of inlet ports are disposed symmetrically about the shaft adjacent said inlet end preceding an end of said impeller at an angle of approximately 45 degrees relative to the shaft.

18. The device according to claim 17, wherein said main portion is cylindrically shaped to form a cylindrically shaped impeller.

19. The device according to claim 17, wherein said impeller rotates at 3450 revolutions per minute.

20. The device according to claim 17, wherein said first and second helixes have relatively smooth surfaces.

21. The device according to claim 17, wherein said first and second helixes have relatively textured surfaces.

22. The device according to claim 17, wherein said fluid discharged from said outlet port is used to drive a motor configured to convert linear flow to rotary motion.

* * * * *